US005813262A

United States Patent [19]

Crumley et al.

[11] Patent Number: 5,813,262

[45] Date of Patent: Sep. 29, 1998

[54] KEY RING ASSEMBLY

[75] Inventors: Gerald B. Crumley, Castaic; Steven M. Kavitky; Sterling Attwood Kavitky, both of Woodland Hills, all of Calif.

[73] Assignee: Sterling Attwood Enterprises, Inc., Woodland Hills, Calif.

[21] Appl. No.: 871,464

[22] Filed: Jun. 9, 1997

[51] Int. Cl.[6] ..... A44B 15/00

[52] U.S. Cl. ..... 70/457; 70/19

[58] Field of Search ..... 70/456 R–460, 70/19, 59, 60

[56] References Cited

U.S. PATENT DOCUMENTS

| | | | |
|---|---|---|---|
| 683,286 | 9/1901 | Houser | 70/19 X |
| 825,184 | 7/1906 | Brandt | 70/457 |
| 978,594 | 12/1910 | Jones | 70/19 |
| 1,156,739 | 10/1915 | Backus | 70/19 |
| 1,293,109 | 2/1919 | Kaplan | 70/19 |
| 1,343,847 | 6/1920 | Reid | 70/19 X |
| 1,376,049 | 4/1921 | Stretch | 70/19 |
| 1,447,374 | 3/1923 | Bowzer | 70/19 |
| 1,484,532 | 2/1924 | Quigley | 70/456 R |
| 1,984,069 | 12/1934 | Larter | 70/457 |
| 2,801,038 | 7/1957 | Hamel | 70/459 |
| 3,659,759 | 5/1972 | Walton | 70/458 X |
| 4,891,961 | 1/1990 | Tsamas | 70/457 X |

*Primary Examiner*—Suzanne Dino Barrett
*Attorney, Agent, or Firm*—John J. Posta, Jr.

[57] ABSTRACT

The key ring assembly includes a normally open, flexible, resilient hoop having elastic memory and fabricated of plastic or the like. The key ring assembly has an inverted generally U-shaped upper end and integral, spaced diverging downwardly extending legs bearing integral grippers at their lower ends, the grippers being in the form of claws facing each other and extending into the central space therebetween. The hoop also has a releasable lock in the form of a first bar integrally connected to the inner surface of one leg above the claws, preferably at about the mid-point of the hoop, extending into the central space and bearing teeth on its upper surface, and a second similar bar integral with the inner surface of the opposite leg and releasably securable to the first bar by a number of spaced integral tabs depending from the underside thereof. The upper surface of the second bar has an upwardly extending integral lever arm for disconnecting the two bars. The mid-portion of the legs is expanded and may bear advertising indicia or the like. The sides of the first bar are expanded to also bear advertising indicia. The bars, when locked, divide the central space into upper and lower key-retaining areas. An integral ring may extend up from the upper end of the hoop. The key ring can be inverted to hold keys while the bars releasably secure them in place and while the claws releasably clamp over a belt or the like.

8 Claims, 1 Drawing Sheet

KEY RING ASSEMBLY

BACKGROUND OF THE INVENTION

1. Field of the Invention

The present invention generally relates to retaining means and more particularly to an improved key ring assembly having multiple uses and which bears advertising indicia or the like.

2. Prior Art

The usual types of key chains comprise a string of metal beads for threading through the openings in keys. Another form of key retainer comprises a flat cylinder of overlapping turns of wire onto which a key is inserted. There are also key retainers in the form of small spaced hooks dangling from the inner surface of a case of leather or the like. However, none contain a device integral therewith which enable the keys to be clamped to a person's shirt, dress or like location. Moreover, none of such key retainers provide enlarged surfaces which are utilizable at the key sites for the imprinting, embossing or otherwise affixing advertising indicia thereto. Moreover, many of such key retainers are expensive to make and therefor not adaptable for use in advertising give-aways for sports events and the like.

Accordingly, there remains a need for a key retainer which provides needed advertising space thereon, is simple and inexpensive to make and easy to use and which, in contrast to most key retainers, can be easily connected to and disconnected from an article of clothing or wearing apparel such as a belt, shirt or pants so as to be readily available and to prevent the loss of the key retainer and the keys thereon. It also would be desirable to be able to provide such a key retainer in a form which could be used upright or inverted, as desired.

SUMMARY OF THE PRESENT INVENTION

The improved key ring of the present invention satisfies all the foregoing needs. The key ring is small in size, light in weight, inexpensive, easy to use and has one or more broad surfaces bearing advertising indicia. It can be easily connected to an article of clothing or wearing apparel. It can be used in the upright or in the inverted position.

The key ring of the present invention comprises a normally open, flexible, resilient hoop of plastic, rubber or suitable resilient thin strip of metal or the like. The hoop has a curved upper end and integral depending and a diverging spaced pair of legs, the lower ends of which bear claws facing into the central space therebetween and which can be pushed together by squeezing the lower portions of the legs toward each other. The claws can readily grip clothing, etc., to hold the key ring assembly in place.

The claws can be releasably held in the closed connected position by an automatic locking and releasable lock in the form of a first elongated bar integrally connected to the inner surface of one of the legs, extending approximately horizontally or sloping downwardly into the central space between the legs well above the claws and bearing teeth on its upper surface, which teeth preferably slope rearwardly. A second similar elongated bar is integrally connected to the inner surface of the second leg at the level of the first bar and extends approximately horizontally or sloping downwardly into the central space toward the first bar. The second bar includes a hook located under the end of the bar at the end thereof, and a plurality of spaced tabs integral with and depending from the underside of said second bar at the sides thereof to assist in aligning the bars. The hook is adapted to engage pre-selected teeth on the first bar to apply clamping pressure by the claws. The second bar also includes an upstanding integral lever arm which can be used to disengage the second bar from engagement with the first bar. The lever arm may have an abraded inner surface to facilitate its non-slip use.

The inner and outer surfaces of the legs along the middle portion thereof are expanded in size and can bear advertising indicia or the like imprinted, embossed or otherwise affixed thereto, if desired. The first bar is of sufficient depth to provide an adequate advertising surface below the teeth of the bar.

The key ring can include an integral small ring extending up from the upper end thereof to enable the insertion of a chain or wire ring containing a set of keys.

Preferably, the entire key ring assembly is molded in a single plastic molding operation so that its cost can be kept to a minimum. Other features of the improved key ring assembly of the present invention are set forth in the following detailed description and accompanying drawings.

DRAWINGS OF A PREFERRED EMBODIMENT OF THE KEY RING ASSEMBLY OF THE PRESENT INVENTION

DETAILED DESCRIPTION OF THE KEY RING ASSEMBLY OF THE PRESENT INVENTION

FIGS. 1–6

Figure 1:
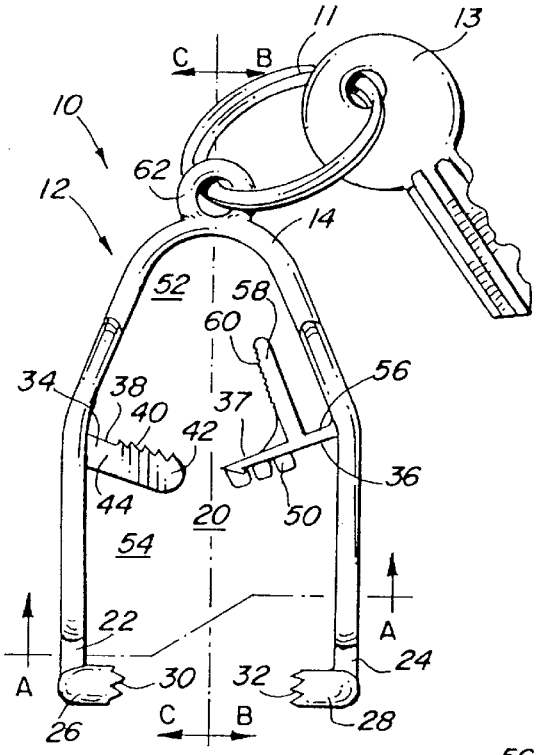
FIG. 1 is a schematic front elevation of a preferred embodiment of the improved key ring assembly of the present invention.
Figure 2:
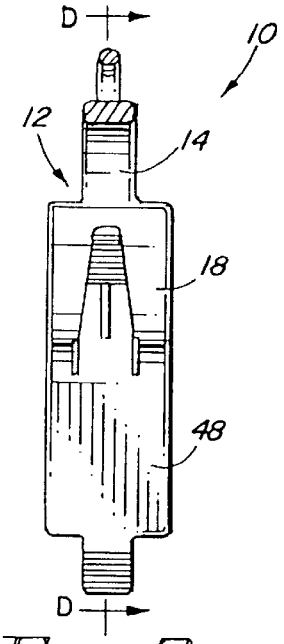
FIG. 2 is a sectional view of the key ring assembly of FIG. 1, taken along the section line B—B of FIG. 1, without including the key or key ring.
Figure 3:
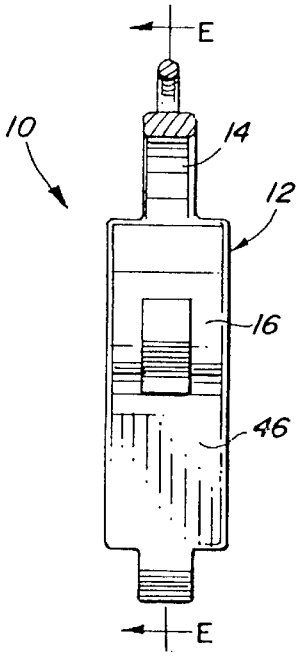
FIG. 3 is a sectional view of the key ring assembly of FIG. 1, taken along the section line C—C of FIG. 1, without including the key or key ring.
Figure 4:
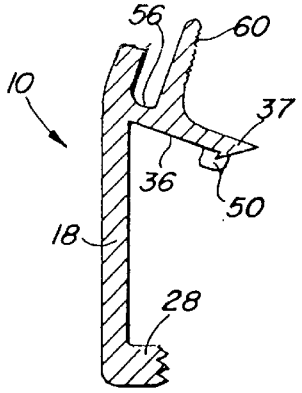
FIG. 4 is a sectional fragmentary view, partly broken away, of a lock bar of the key ring assembly of Figure, taken along the section line D—D of FIG. 2.
Figure 5:
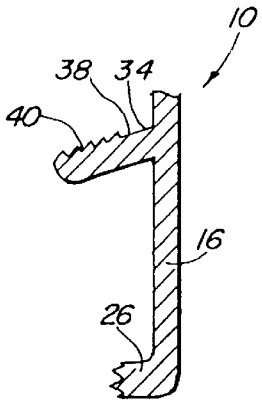
FIG. 5 is a sectional fragmentary view of a second lock bar of the key ring assembly of FIG. 1, taken along the section line E—E of FIG. 3; and, FIG. 6 is a sectional fragmentary view of a lower portion of the key ring assembly of FIG. 1, taken along the section line A—A of FIG. 1.
Figure 6:
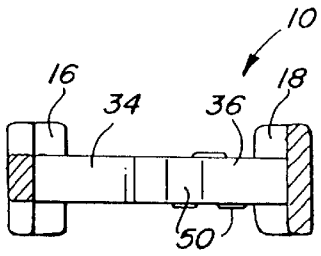

Now referring more particularly to FIGS. 1–6 of the drawings, a preferred embodiment of the improved key ring assembly of the present invention is schematically depicted therein. FIG. 1 depicts the key ring assembly in full view, while FIGS. 2–6 show the various components of the key ring assembly in sectional views.

Thus, key ring assembly 10 is shown, which comprises a flexible resilient clamping member 12 having elastic memory and which is preferably plastic, rubber or the like, or a flexible resilient thin strip of metal and which has an inverted generally U-shaped configuration best seen in FIG. 1. Clamping member 12 includes a curved top portion 14 and integral depending and diverging legs 16 and 18 defining with top 14 a generally central space 20 between top 14 and legs 16 and 18. Key ring assembly 10 includes an integral, hollow small ring 62 extending upwardly from top 14 and used to attach a ring 11 with a key 13 thereto, or to receive a chain (not shown) or the like carrying keys.

Member 12 also includes at the lower ends 22 and 24 of legs 16 and 18, respectively, closure means in the form of a pair of claws 26 and 28, respectively, facing each other and passing into space 20. Claws 26 and 28 each have a plurality of fingers 30 and 32, respectively, which can be forced towards one another to hold an article between them by finger squeezing the lower ends 22 and 24 of legs 16 and 18 toward each other until claws 26 and 28 approach one another. Claws 26 and 28 in this position can clamp onto an object, such as an article of clothing, whereby the key ring assembly 10 is held in place on such article.

In order to hold and lock claws 26 and 28 in the close position just described, clamping member 12 also includes releasable locking means in the form of first and second integral elongated bars 34 and 36. Bar 34 extends into space 20 preferably about midway down member 12, as shown in FIG. 1, and is integrally connected to the inner surface of leg 16. It bears on its upper surface 38 a plurality, in this instance 5, of sharp pointed teeth 40 extending upwardly therefrom and preferably slanted back toward leg 16 for greater gripping power.

It will be noted that the sides 42 of bar 34 may be relatively deep and may contain printed, embossed or engraved advertising indicia 44, such as the legend "KEEP IT" shown in FIG. 1. It will also be noted from FIGS. 2 and 3 that the middle portions 46 and 48 of legs 16 and 18, respectively, are expanded so that they may also contain such advertising indicia (not shown).

Bar 36 is similar to bar 34 and is integral with the inner surface of leg 18, extending into space 20 opposite bar 34. The end of bar 34 has a depending tooth 37 adapted to releasably interlock with teeth 40. Bars 34 and 36 are so positioned that when legs 16 and 18 are pressed together, tooth 37 slides up and over the end of bar 34 while being biased downwardly, and over teeth 40 until it interlocks with one of the teeth 40. This action serves to clamp claws 26 and 28 to an article therebetween and hold it in place. The clamping action of claws 26 and 28 is released by pressing together a lever arm 58 (integral with bar 36) and leg 18, which causes teeth 40 and tooth 37 to disengage.

FIG. 1 shows key member 12 in the relaxed position wherein bars 34 and 36 face each other in space 20 but are spaced from each other. Preferably, bars 34 and 36 slope downwardly, as shown in FIG. 1, when member 12 is in the relaxed position, but are approximately horizontal when engaged with each other.

In order to align lock bar 36 to bar 34, bar 36 bears a plurality, in this instance 3, of tabs 50 spaced along the length thereof and depending from the underside 52 thereof at the outside edges of bar 36. Bar 36 and tabs 50 essentially form a pocket into which bar 34 is received to insure proper alignment at the bars 34 and 36, while also insuring that the teeth 40 and 37 are accordingly aligned. When used in the manner described, claws 26 and 28 can releasably hold key ring assembly 10 to a shirt pocket, pants pocket, or the like when clamped together with such article of clothing. Likewise, the jaws 26 and 28 can be clamped tightly together around a loop such as a belt loop to attach the key ring assembly 10 thereto.

Legs 16 and 18 have elastic memory, as do bars 34 and 36, and all components of clamping member 1 can be formed simultaneously in a single plastic molding operation from any suitable plastic such as hylon, Teflon (a registered trademark of E. I. Dupont for polytetrafluoroethylene) or polyethylene, polysilicone, or another suitable material such as rubber, synthetic or natural. Clamping member 12 can be made in any suitable size and thickness commensurate with the requirements and characteristics set forth above.

Various modifications, changes, alterations and additions can be made in the improved key ring assembly of the present invention, its components and parameters. All such modifications, changes, alterations and additions as are within the scope of the appended claims form part of the present invention.

What is claimed is:

1. An improved key ring assembly, said key ring assembly comprising, in combination:

a) a key ring carrying one or more keys;

b) a clamping member attached to said key ring;

c) said clamping member having a generally inverted U-shaped upper end and first and second diverging and depending spaced resilient legs defining a central space therebetween, the lower ends of said legs bearing opposed claws, said claws being movable by finger pressure on said legs between a normally open spaced position and a closed article-engaging position;

d) releasable locking means, said locking means comprising:

i.) a first integral elongated bar connected to the inner surface of said first of said legs, extending inwardly into said central space, disposed upwardly from said claws and bearing teeth on the upper surface thereof; and ii.) a second integral elongated bar connected to the inner surface of the second of said legs, disposed upwardly from said claws and extending inwardly into said central space for releasable engagement with said first bar, said second bar having at least one tooth extending downwardly at the end of said second bar which is releasably engagable with said teeth of said first bar to releasably lock said member in the closed key-retaining, claw-clamping position, said second bar also bearing on the upper surface thereof an upwardly projecting integral lever arm for moving said second bar tooth out of engagement with said teeth of said first bar, and e) advertising indicia disposed on at least one of a) the inner surface of at least one of said legs, b) the outer surface of at least one of said legs, and c) a surface of said first bar.

2. The improved key ring assembly of claim 1 wherein said upper end of said clamping member bears on the upper surface thereof a ring extending upwardly therefrom for attachment of said clamping member to a key ring assembly for holding keys.

3. The improved key ring assembly of claim 1 wherein said lever arm is integral with said second bar.

4. The improved key ring assembly of claim 1 wherein said legs have a generally central expanded area bearing said advertising indicia.

5. The improved key ring assembly of claim 1 wherein in the normally open position said bars project downwardly and inwardly into said central space and in the closed bar position said bars are generally horizontal, and wherein said teeth slant toward said first leg.

6. The improved key ring assembly of claim 2 wherein said second bar includes alignment means to insure alignment of said first and second bars when the assembly is in a clamping position.

7. The improved key ring assembly of claim 6 wherein said alignment means includes a plurality of tabs depending from said second bar adapted to receive and pocket said first bar when the assembly is in a clamping position.

8. The assembly of claim 1 wherein all components of the clamping member are integral molded plastic.

* * * * *